US008925220B2

(12) United States Patent
Stangeland et al.

(10) Patent No.: US 8,925,220 B2
(45) Date of Patent: Jan. 6, 2015

(54) WEAR ASSEMBLY

(71) Applicant: ESCO Corporation, Portland, OR (US)

(72) Inventors: Kevin S. Stangeland, Portland, OR (US); Clinton A. Wood, Tualatin, OR (US); Kate L. Shreeve, Portland, OR (US); Charles G. Ollinger, IV, Portland, OR (US)

( * ) Notice: Subject to any disclaimer, the term of this patent is extended or adjusted under 35 U.S.C. 154(b) by 72 days.

(21) Appl. No.: 13/767,247

(22) Filed: Feb. 14, 2013

(65) Prior Publication Data

US 2013/0212916 A1 Aug. 22, 2013

Related U.S. Application Data

(60) Provisional application No. 61/600,437, filed on Feb. 17, 2012.

(51) Int. Cl.
*E02F 9/28* (2006.01)

(52) U.S. Cl.
CPC ..... *E02F 9/2883* (2013.01)
USPC ..... 37/452

(58) Field of Classification Search
USPC ..... 37/446, 449, 452–460; 172/701.1–701.3, 753, 772, 772.5; 403/375, 376, 379.2–379.4
See application file for complete search history.

(56) References Cited

U.S. PATENT DOCUMENTS 413,116 A 10/1889 Walker
915,809 A * 3/1909 Thomas ..... 37/452
1,728,326 A 9/1929 Borkhuis
1,903,123 A 3/1933 Meyer
2,971,280 A 2/1961 Smedley
3,530,601 A 9/1970 Steil
3,624,827 A * 11/1971 Liess et al. ..... 37/92
4,127,952 A 12/1978 Chamberlain
4,404,760 A * 9/1983 Hahn et al. ..... 37/459
4,625,437 A 12/1986 Curtis et al.
5,412,885 A 5/1995 Cornelius
5,553,409 A 9/1996 Irving
5,709,043 A * 1/1998 Jones et al. ..... 37/458
5,852,888 A 12/1998 Cornelius
5,937,549 A 8/1999 Bender et al.
6,145,224 A 11/2000 Stickling
6,194,080 B1 2/2001 Stickling
6,247,255 B1 * 6/2001 Clendenning ..... 37/452
6,457,269 B1 10/2002 Esterhuyse et al.
6,735,890 B2 * 5/2004 Carpenter et al. ..... 37/456
6,848,203 B2 2/2005 Hohmann et al.
7,882,649 B2 2/2011 Carpenter et al.
2004/0098886 A1 5/2004 Hohmann et al.
2005/0132619 A1 6/2005 Robinson
2007/0204490 A1 9/2007 Jones et al.
2009/0320333 A1 12/2009 Martinez et al.

* cited by examiner

*Primary Examiner* — Robert Pezzuto

(57) ABSTRACT

A wear assembly with strain relief protects exposed surfaces of excavating equipment such as a bucket lip. Wear components may include a seat where loads are applied, welding flanges flanking the seat on opposite ends of the component welded to the equipment, and strain relief areas between each welding flange and the seat. The strain relief balances stresses from loading in the wear assembly across the weld flange to limit cracking from stress concentrations. Strain relief may include modification of material properties or modification of component configuration to reduce stiffness of the component between the weld flanges and the seat.

6 Claims, 11 Drawing Sheets

WEAR ASSEMBLY

CROSS-REFERENCE TO RELATED APPLICATION

The present application claims priority to U.S. Provisional Application No. 61/600,437, filed Feb. 17, 2012, which application is incorporated by reference herein in its entirety and made part hereof.

FIELD OF THE INVENTION

This invention relates to various wear members and wear assemblies for use with earthmoving equipment.

BACKGROUND OF THE INVENTION

Excavating buckets and other earthmoving equipment are subjected to harsh conditions including abrasive materials, extreme loads and cyclic stresses and strains. Various wear members and wear assemblies are attached to lips, other digging edges and surfaces to protect them from wear and erosion. The wear assemblies extending from the digging edges and surfaces experience high internal stresses during operation which can result in failure of the components. The wear assemblies require adequate strength to avoid failure, but also have to incorporate ductility in order to transfer applied loads across a broad support structure without excessive stress concentrations at critical points. Fatigue due to cyclic loading combined with concentration of stress within localized areas of the components can cause reduced service life or catastrophic failure in the wear assembly.

SUMMARY OF THE INVENTION

Wear members for mining and other earthmoving equipment are sacrificial components that are frequently replaced. They overlie the lips or other surfaces of excavating buckets and other earthmoving equipment that would otherwise be exposed and in contact with the ground. Excavated materials are abrasive and the wear members can be worn away quickly. The loads applied to the wear members during digging are varied and include, for example, axial, vertical and side loads. The loads come in various forms such as impact, vibration and reverse loads.

Mining and excavation equipment can move tons of materials in a single cycle. These large loads require components that can absorb and withstand the applied stresses. Stress within the components can be extreme even with very large components and design of a component requires balancing of strength and ductility. Excessive stiffness or brittleness of the components can induce cracking at critical points of the assemblies such as welds and sharp inside corners. These kinds of features can focus applied stresses to critical levels. The components must also be ductile enough to flex allowing loads to be distributed across all of the supports for the component.

In accordance with the present invention, a wear component includes a strain relief area that regulates and balances stresses in the component caused by the applied loads. The strain relief area is a portion of the component that has a modified material property such as modulus of elasticity or a modified component property such as stiffness.

The strain relief may include thinning of the material, narrowing of the material or a change in material properties in the strain relief area. This results in a decrease in stiffness in the strain relief area in contrast to the balance of the component. The strain relief area flexes and deflects to distribute the stresses across the component support or anchor. Strain relief is effective, for example, between a component support such as a weldment and a loaded area such as the working end of wear member or a seat that receives a wear member.

In one aspect of the invention, a wear component for earthmoving equipment is provided with a mounting portion, a working portion and a strain relief area between the mounting portion and the working portion. The mounting portion is fixed to the equipment. The working portion operates as a seat for a wear member or a wear surface to contact the ground. The strain relief area is provided between the two portions to permit sufficient flexibility to reduce the risk of cracking or failing of the fixed attachment on account of the applied loads. This enables greater reliability in the wear components and generally a longer usable life.

In one embodiment, the wear component is a base for supporting a wear member on earthmoving equipment such as the lip of an excavating bucket. In this one embodiment, the base wraps around the front edge of the lip and includes a mounting portion at each end, i.e., with one mounting end overlying an inside surface of the lip and one mounting end overlying an outside surface of the lip. The working portion extends between the mounting ends and defines a seat for supporting a wear member (e.g., a shroud) on the lip. The mounting ends are welded to the lip while the working portion remains free of welding. In this example, the strain relief area includes a pair of opposite, laterally-open slots, which define a narrow region between the mounting portion and the working portion.

In another embodiment, the wear component is a wear member that is welded to the earthmoving equipment such as a lip of an excavating bucket. In this embodiment, as with the previous embodiment, the wear member includes mounting ends to be fixed to the inside and outside surfaces of the lip. The working portion is a wearable portion that extends between the mounting ends to contact the earthen materials and, e.g., protect the underlying lip. The wear member in this example may be a shroud.

The invention is also applicable to other mining and earthmoving applications such as a base for a runner or a weld-on wear member for use on a surface of an excavator bucket, chute, truck body or other equipment.

As another alternative embodiment, the entire unwelded portion of the wear component may comprise the strain relief area. In one embodiment, weld portions at opposite ends of the wear component may be welded to a support structure. A middle portion (i.e., the working portion) of the wear component not welded to the support structure is free to flex and deflect within the limits of the welded flanges, i.e., without a specifically defined narrow region.

In one other embodiment of the invention, a base for mounting a wear member to a digging edge of excavating equipment includes a seat to receive the wear member, and inner and outer weld flanges rearward of the seat, each weld flange welded to one of an inner surface and an outer surface of the digging edge of the earthmoving equipment where the seat and strain reliefs are separate from the digging edge.

In another embodiment, a lip of an excavating bucket having an interior scoop structure and an exterior surface comprising a main member having an upper surface forming a part of the interior scoop structure of the bucket, a lower surface adapted to form a part of the exterior of the bucket and a front edge face extending across the front of the main member interconnecting the upper and lower surfaces. The lip further includes a base for mounting a wear member including a seat that overlies the main member to receive the wear member, a first welding flange rearward of the seat welded to the upper surface of the lip, and a second welding flange rearward of the seat welded to the lower surface of the lip.

In another embodiment, a wear assembly comprises a base adapted to be welded to a bucket of an excavating machine, wherein the bucket has a digging edge with an inner face, an outer face and a front edge face. The base includes a seat bearing on the front edge face and extending from the front edge face along the inner and outer faces of the digging edge and separate from the digging edge, and at least one a weld flange rearward of the seat secured to the inner or outer face of the digging edge. A wear member is received over the base and includes an aperture generally aligned with a retention feature on the base. A lock is received in the aperture to bear against the retention feature of the base and hold the wear member to the base.

In another aspect of the invention, a wear component for earthmoving equipment is provided with a pair of mounting portions and a medial working portion. The mounting portions are defined at opposite ends of the wear component and are welded to the underlying support. In one example, the underlying support could be a lip of an excavating bucket, but it could be other surfaces subjected to earthen materials. In the various applications, the working portion remains free of being welded to the underlying support. This arrangement requires less welding so as to speed removal and attachment, and reduces the risk of damaging the underlying support structure (such as a lip), while still maintaining a secure attachment of the wear component (whether it be a base or wear member) to the underlying support.

DETAILED DESCRIPTION OF THE DISCLOSURE

FIGS. 1-5 illustrate a preferred embodiment of the invention. FIGS. 6-12 show alternative embodiments.

Figure 1:
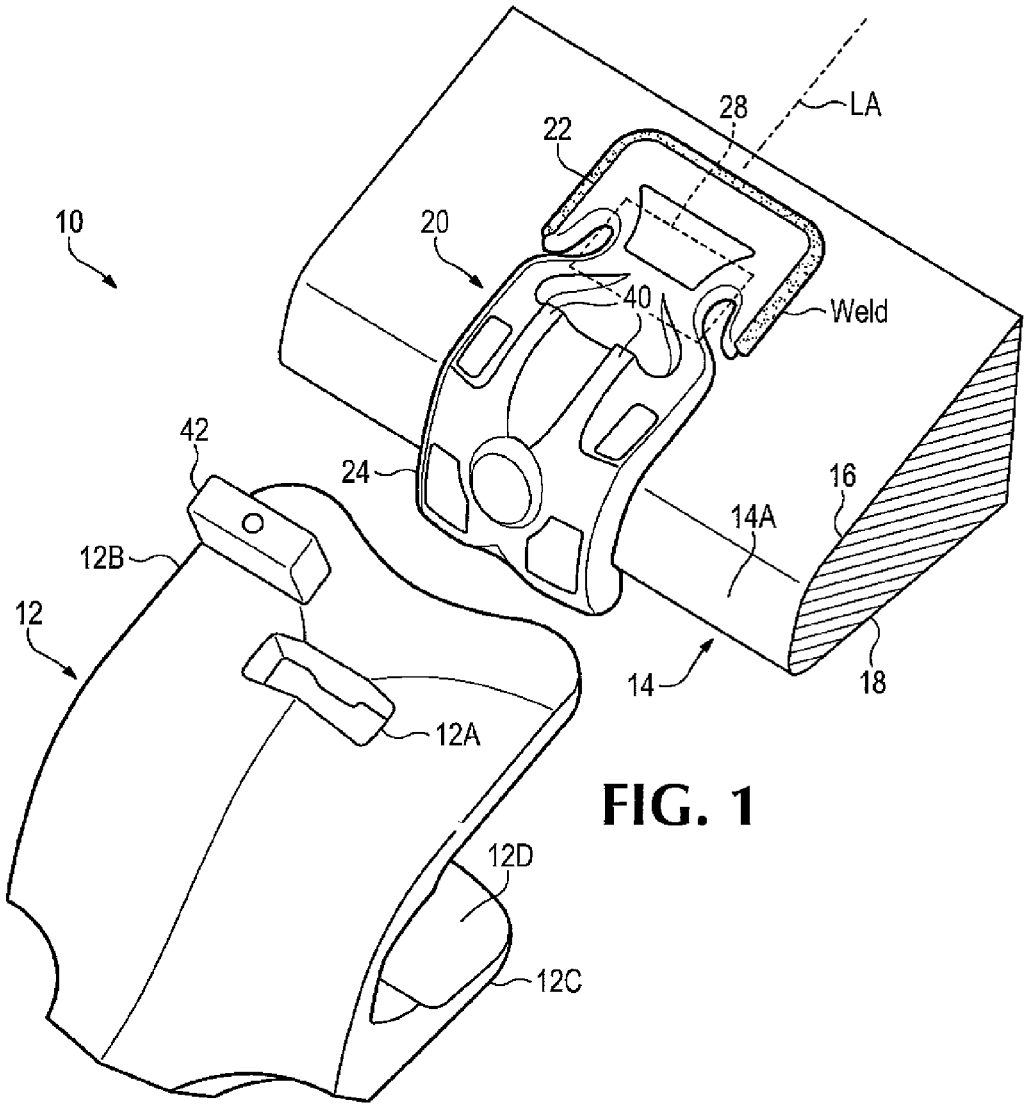
FIG. 1 is an exploded perspective view of a wear component in the form of a base attached to an underlying support in the form of an excavator lip with the base receiving a wear member.

FIG. 1 is an example of a wear assembly 10 including a wear member 12 being assembled to a base 20. Base 20 is fixed to a lip 14 of excavating equipment with an inside or upper surface 16, an outside or lower surface 18, and a front edge face 14A joining the upper and lower surfaces. Base 20 bears on the front edge face and extends rearward along the upper and lower surfaces. Wear member 12 and base 20 are each considered a wear component of assembly 10.

Wear member 12 in this illustrated embodiment is a shroud. The wear member includes an opening 12A to receive a retention system or lock 42 to secure the wear member to the base 20. Wear member 12 has bifurcated legs extending backwards so as to straddle lip 14. The upper leg 12B as shown is longer and extends farther rearward than the lower leg 12C, but other arrangements are possible.

Loads applied to wear member 12 during operation are transferred through base 20 to the digging edge or lip of the equipment. Substantial loads are applied to the wear assembly during operations generating high stresses in the base and especially at the connection of the base to the lip. These loads are cyclic in nature and have in the past tended to generate fatigue failures in either the base or the weld connecting the base to the lip or in regard to other wear components welded to the lip or other portions of earthmoving equipment during digging operations. The present invention reduces this risk of cracking or failure by providing some freedom of movement between the working portion (which in this embodiment is a seat) and the mounting ends that, in turn, reduces the stress concentrations that can build up and lead to damage and/or loss to the weld or component.

Base 20 includes a working portion or seat 24 at a forward end that wraps around the lip, and a mounting portion or flange 22 at each distal rearward end of base 20. Mounting portion 22 is welded to lip 14, and preferably around the entire outside edge, i.e., along back edge 22A and side edges 22B and 22C, though other arrangements (i.e., with gaps) could be used. The mounting portions could be fixed to the lip by other means such as, e.g., bolting or having the mounting portions cast with the lip or other underlying surface. Base 20 supports wear member 12 with seat 24 being received into a cavity 12D of wear member 12 on assembly, though mounting portions can also contact the wear member. In the illustrated embodiment, pad areas 23 and 25 on base 20 contact wear member 12 during use. The seat could have a wide variety of different constructions to suit the particular wear member to be secured. Although base 20 is subject to wear and requires periodic replacement, it is covered by wear member 12 during operation resulting in a lower wear rate as compared to wear member 12. As a result, it is replaced less frequently than wear member 12.

Base 20 includes an upper welding flange 22 and a lower welding flange 26. Base 20 defines a longitudinal axis LA that extends rearward from the seat between the upper and lower welding flanges 22 and 26. Wear member 12 may be assembled to base 20 along longitudinal axis LA.

Figure 2:
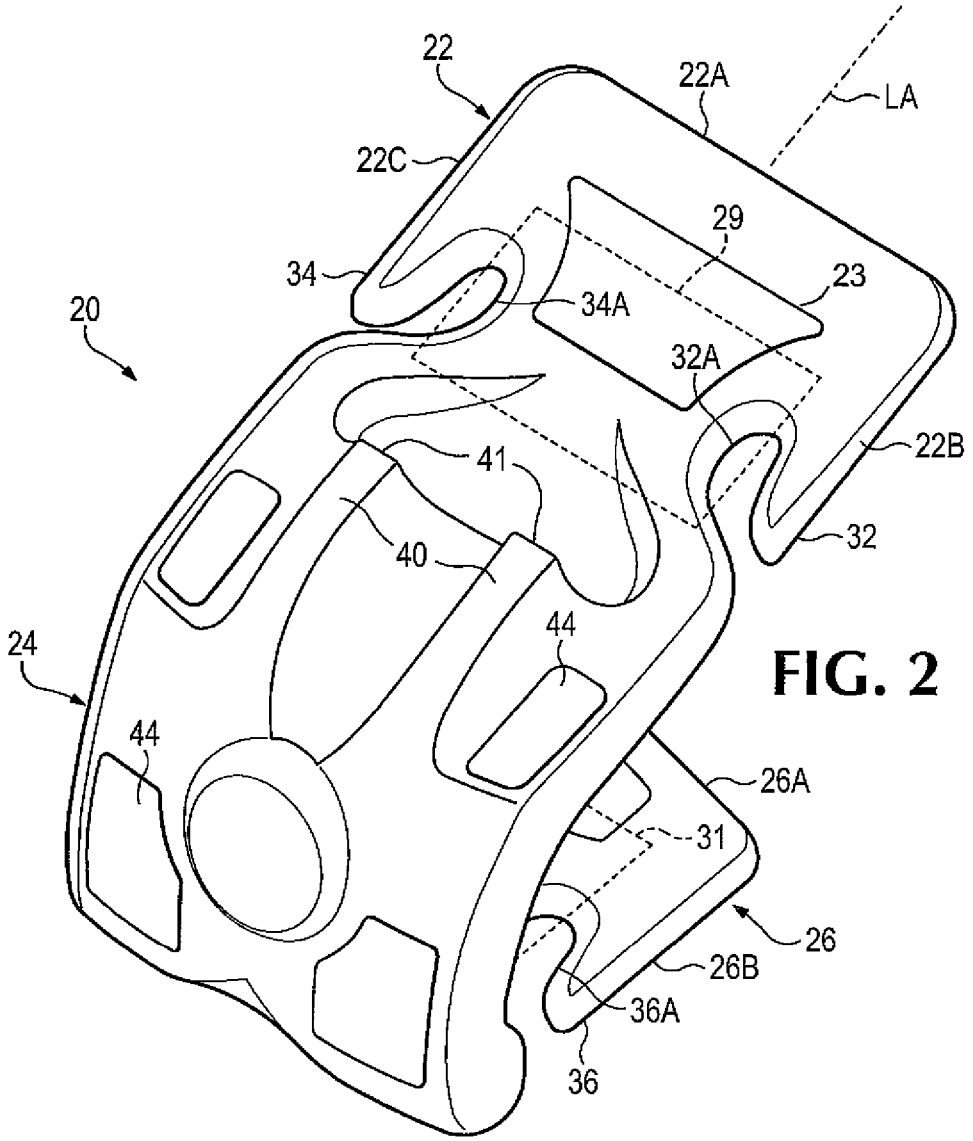
FIG. 2 is a perspective view of the base of FIG. 1.
Figure 3:
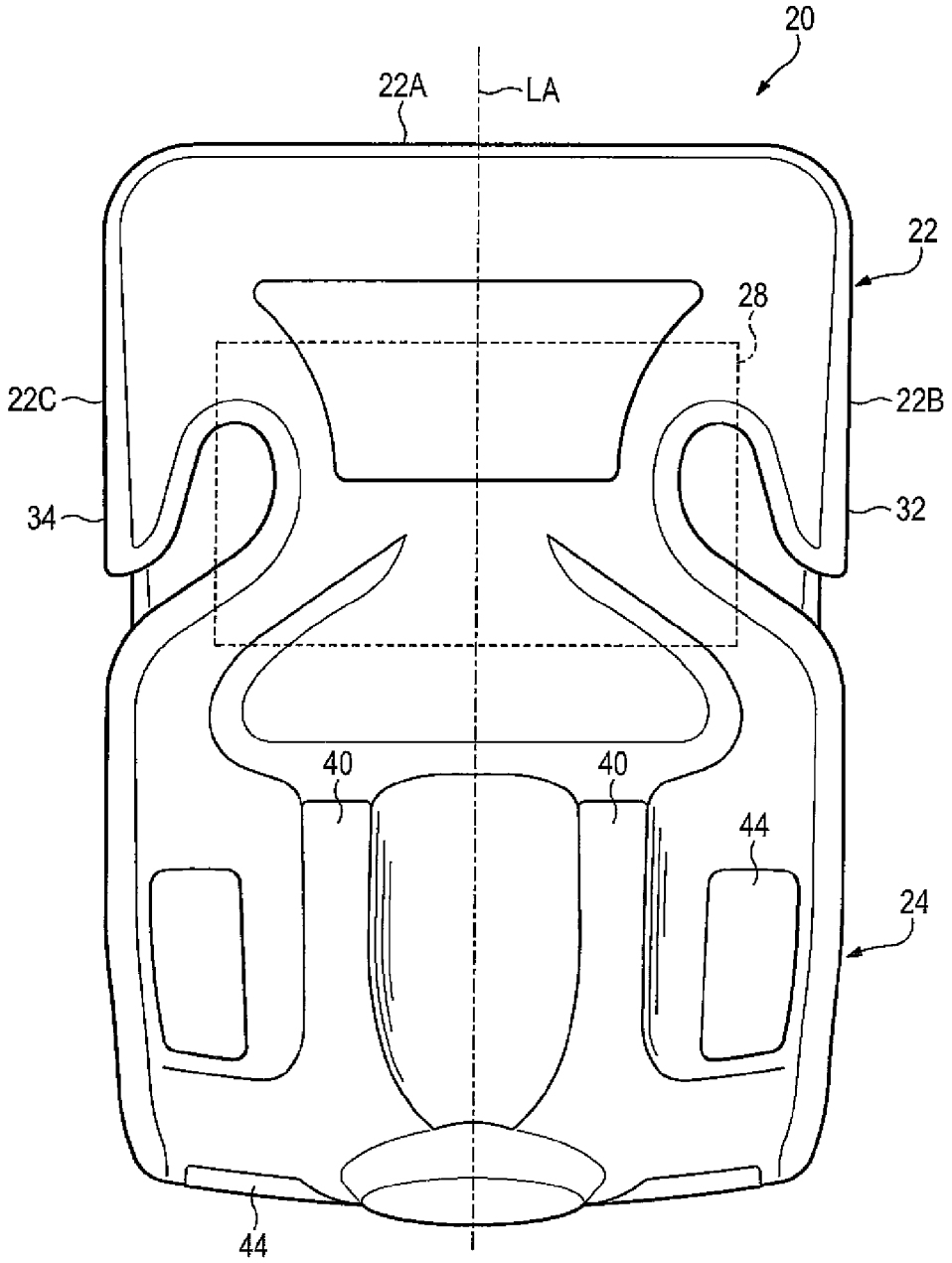
FIG. 3 is a top view of the base.
Figure 4:
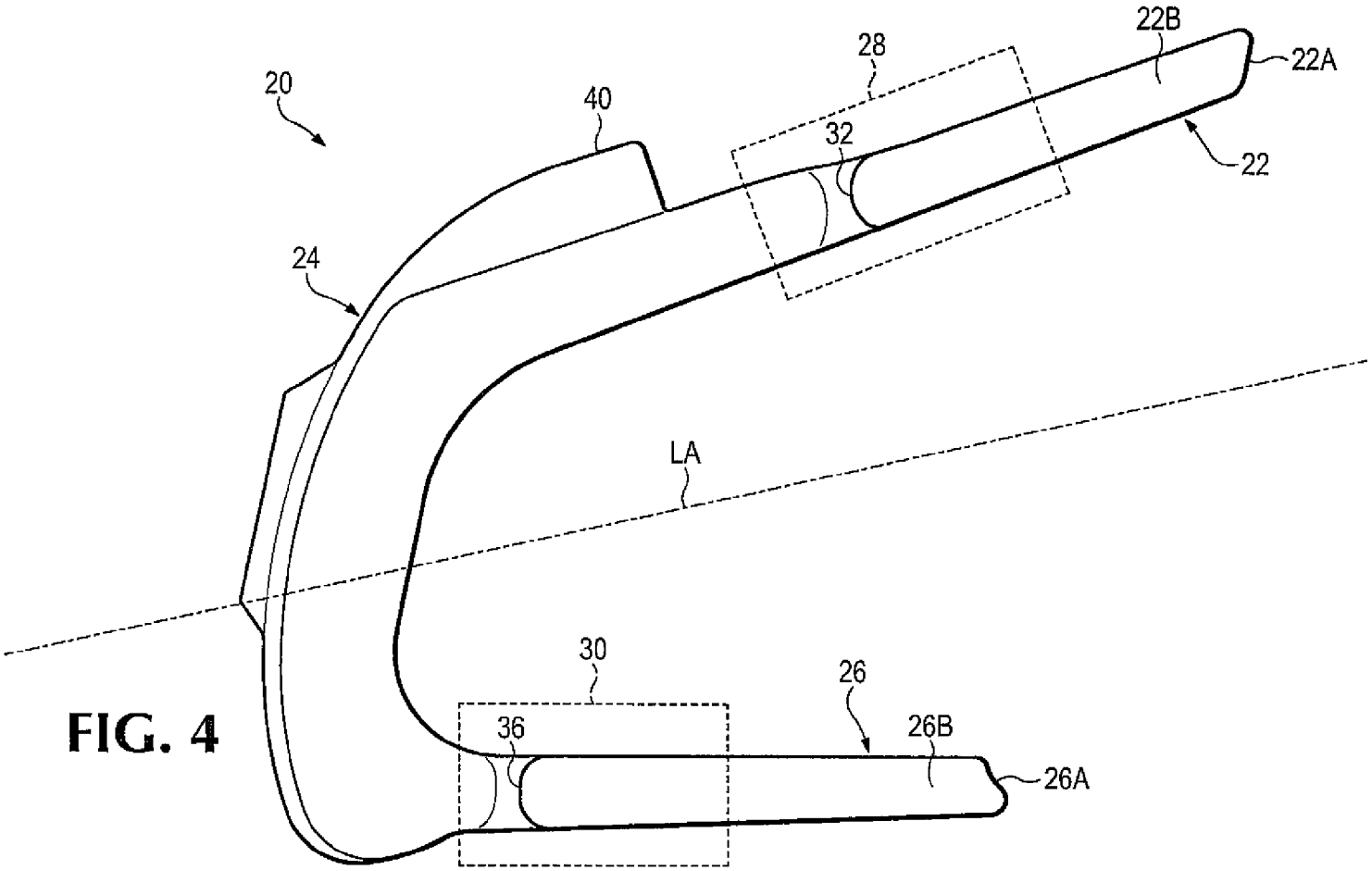
FIG. 4 is a side view of the base.
Figure 5:
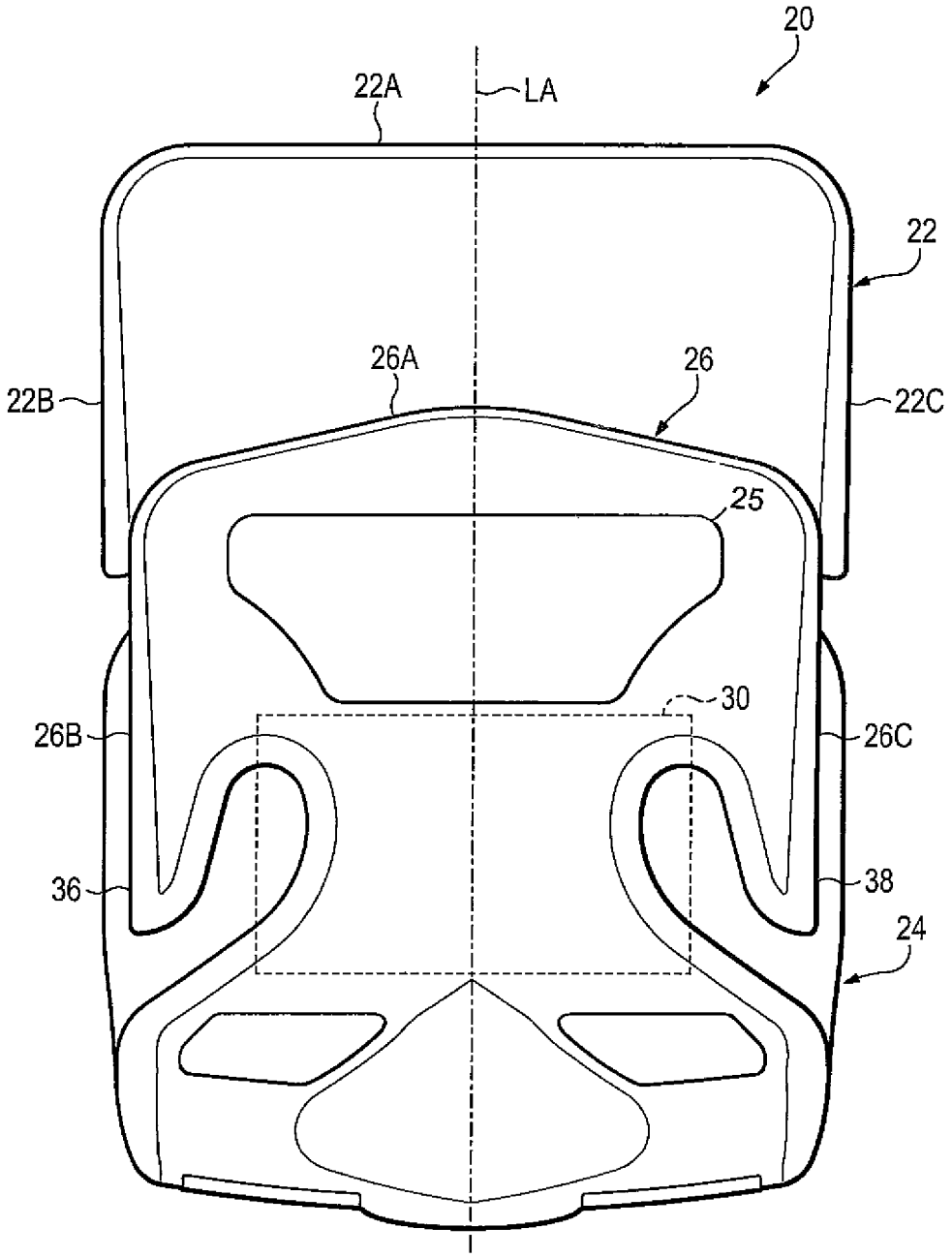
FIG. 5 is a bottom view of the base.

Base 20 includes a weld relief or strain relief area 28 between mounting or welding portion 22 and working portion 24, and weld relief or strain relief area 30 between mounting or welding portion 26 and working portion 24. The strain relief area can be configured in many different ways. In the embodiment of FIG. 2 weld relief or strain relief area 28 indicated by the dotted line is a throat or narrowed region 29. Strain relief area 30 connecting welding flange 26 to seating portion 24 is also a throat 31. A strain relief area adjacent each welding portion is preferred, though in certain applications a strain relief area could be provided between only one welded end 22 and the seat 24.

Upper weld flange 22 may include upper side portions 32 and 34 that extend forward on each side of throat 28. The side portions spaced from the throat portions define upper side openings or channels 32A and 34A between the throat and side portions. Lower weld flange 26 may also include lower side portions 36 and 38 extending forward on each side of throat 30. The side portions spaced from the throat portion creates lower side openings or channels 36A and 38A (hidden here) between the throat and side portions. The channels are shown with a particular curved shape, but they could have a wide variety of configurations.

The lower welding flange 26 is preferably welded to bottom surface 18 of lip 14 along back edge 26A, and side edges 26B and 26C. Likewise, in this embodiment, the strain relief area 30 connecting the lower welding flange 26 to the seat 24 is the same configuration as the strain relief area 28 connecting the upper welding flange to the seat, though they could be different.

Upper and lower flanges 22 and 26 serve as the primary supports for base 20. Upper and lower throat areas 29 and 31 are narrower than the seat and adjacent the weld flanges and the seat. The width of features such as throat 29 is defined in a direction transverse to the longitudinal axis LA. In this embodiment, throats 29, 31 have a width that is about 80% of the maximum width of seat 24, but a wide variety of other arrangements with bigger or smaller ratios between the throat and seat widths are possible.

The sides and back of the weld flanges are used to weld the flanges to upper and lower faces 16 and 18 of lip 14. One or more weld beads are laid down between the flange edges and the lip surfaces to secure the flanges to the lip. Both upper and lower weld flanges 22 and 26 are secured to lip 14. The balance of the surfaces including the throat and seat are free of welds. Seating portion 24 and other features are separate and uncoupled from lip 14 in that they are not attached directly to the lip and can move independently of the lip, though they do bear against the lip during use.

A more rigid structure without strain relief areas cannot as effectively distribute an applied load with reduced stress build in the part or weld. Where the structure is too stiff, cracking tends to occur, primarily at inside corners, welds and other points that concentrate the stress or have experienced material hardening processes that lower the strength of the materials. The construction of the present invention with strain relief tends to alleviate excessive stress concentrations and results in a reduced risk of cracking or failure of the part or weld.

Loads applied to wear member 12 are primarily transferred to seat 24. Seat 24 is constrained through upper and lower throats 29 and 31 which act as strain relief areas 28 and 30 of base 20. Seat 24 under load deflects within the constraints of throats 29 and 31 which flex more than any other portion of base 20 as they are less stiff than seat 24 or flange 22.

Upper and lower throats 29 and 31 are in turn constrained by the welds along the perimeter of the flanges at edges 22A, 22B, 22C, 26A, 26B and 26C. This deflection of seat 24, and the central location of the throat in relation to the welded surfaces, allows the applied stresses to better dissipate to the entire weldment around the flanges.

Unlike the prior art, the flexing provided by the strain reliefs reduces the risk of cracking base 20 or disrupting the welds that attach base 20 to the lip. This inventive construction allows the stress relief areas to absorb much of the energy by flexing and deforming. Finite Element Analysis (FEA) comparisons between bases without a weld relief versus those with a weld or strain relief of the present disclosure show between a 50% to 90% reduction in peak weld stress with the addition of the present strain relief areas. Lifecycle results in the lab and in field testing have shown similar improvements to the service life of the components.

Throat portions of base 20 are designed to bend elastically. Any plastic deflection of a strain relief giving a permanent set or deflection to base 20 would be beyond the designed limits of the components. A permanent deflection of the strain relief risks creating cracks in the strain relief and creating stress concentration points that induce further crack propagation.

Figure 6:
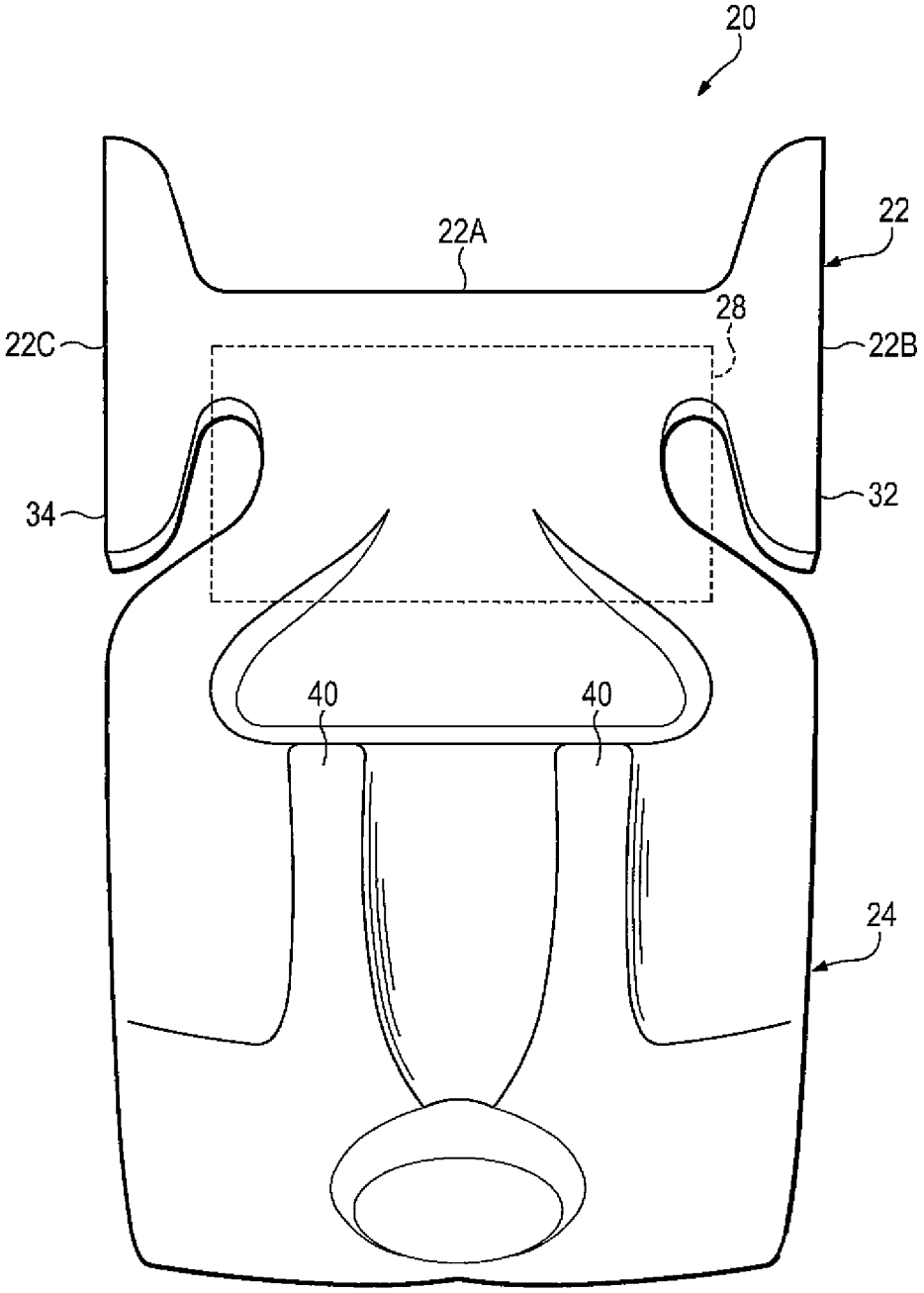
FIG. 6 is a top view of an alternative configuration of a wear component in the form of a base.

Weld flanges are shown as having a rectangular perimeter, but other configurations can be used. The perimeter of the welding flange could be arcuate or could have additional protrusions that extend rearward as illustrated in FIG. 6. Alternatively or in addition, the welding flange could have protrusions extending transversely to the side. Additional protrusions could provide additional support or anchoring of the base to the lip.

Figure 7:
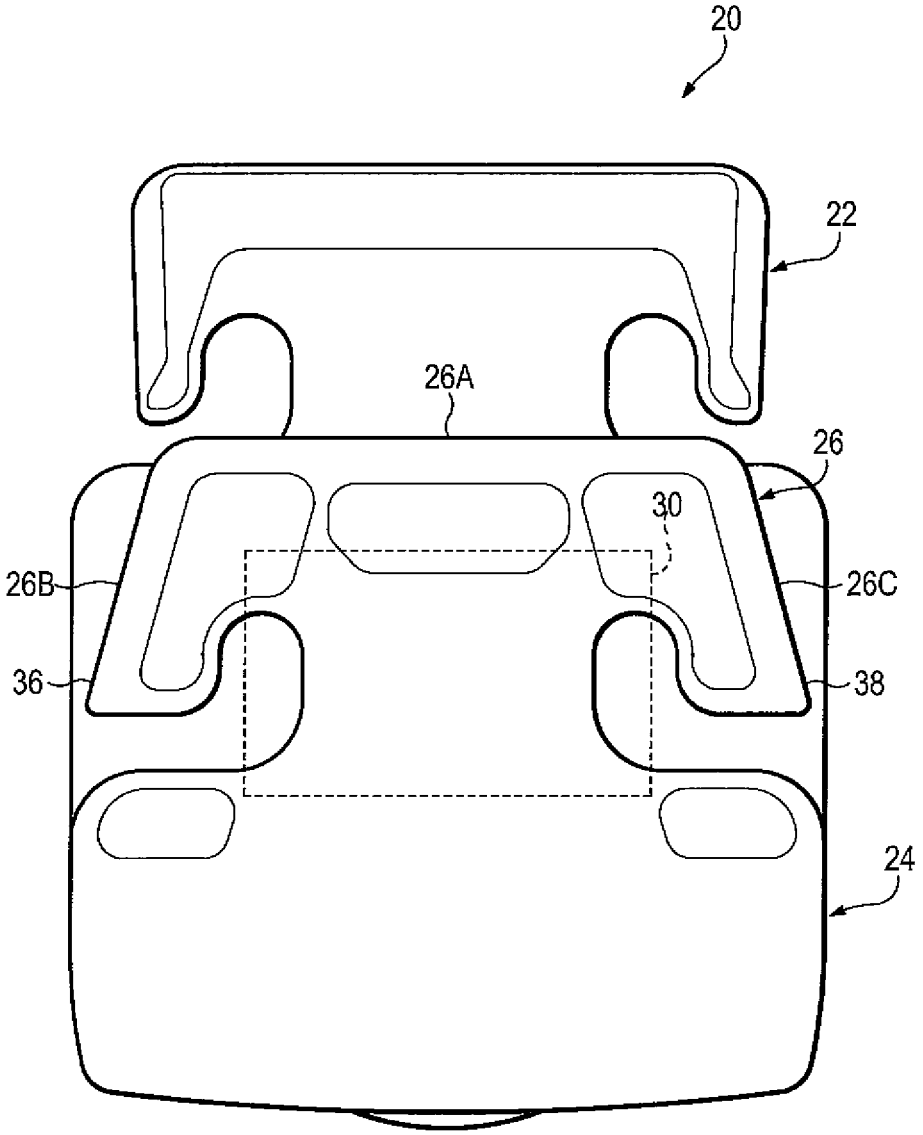
FIG. 7 is a bottom view of the base with an alternative configuration.

The specific design of the weld flange and the side channels may vary widely. The edges forming channels 32A, 34A, 36A, 38A may be arcuate as shown in the previous examples. In an alternative configuration as shown in FIG. 7 the edges of the channel may include portions that are parallel to the longitudinal axis LA and some portions that are transverse to the axis. Lower weld flange side edges 26B and 26C as shown are inclined to the longitudinal axis.

Figure 8:
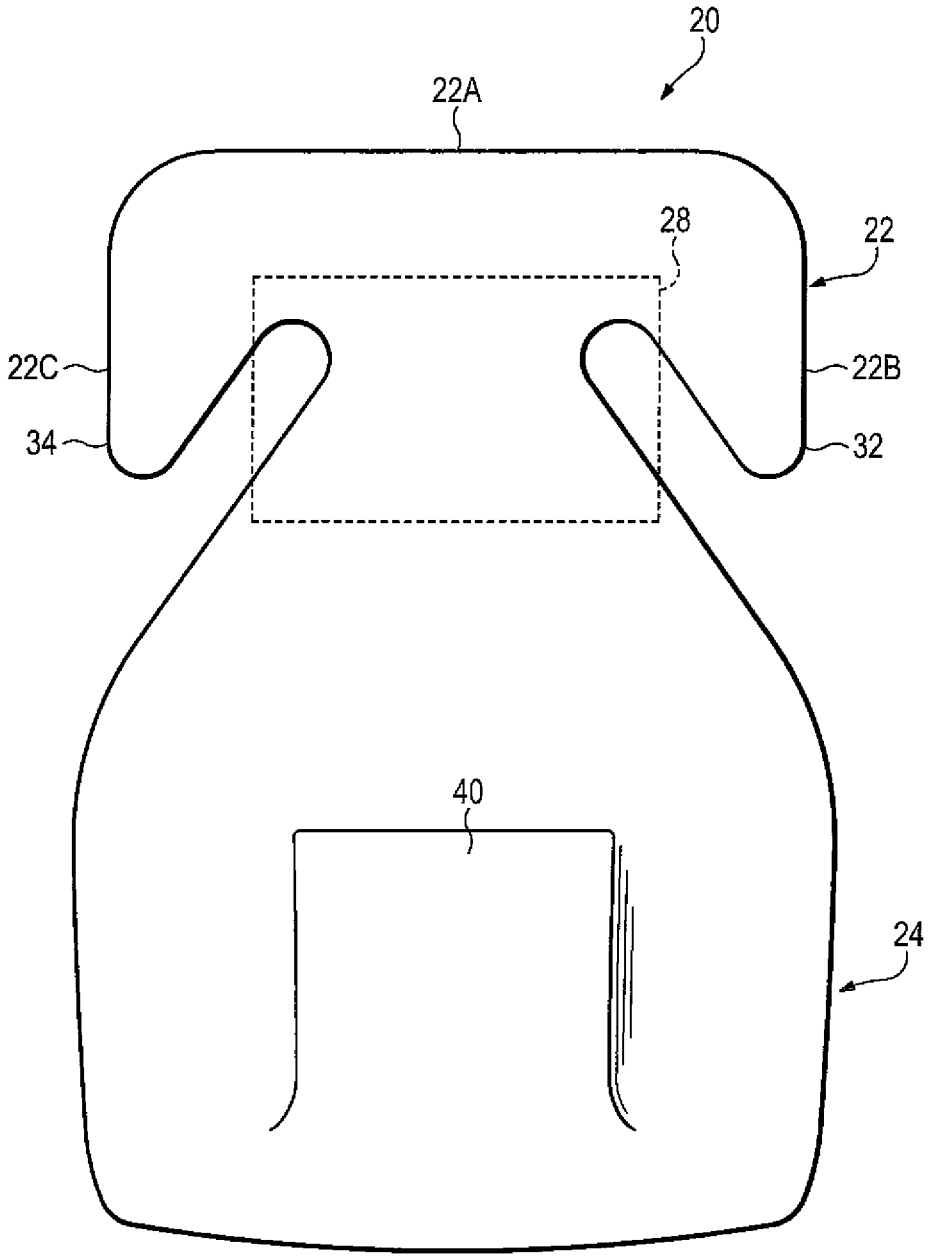
FIG. 8 is a top view of the base with another alternative configuration.
Figure 9:
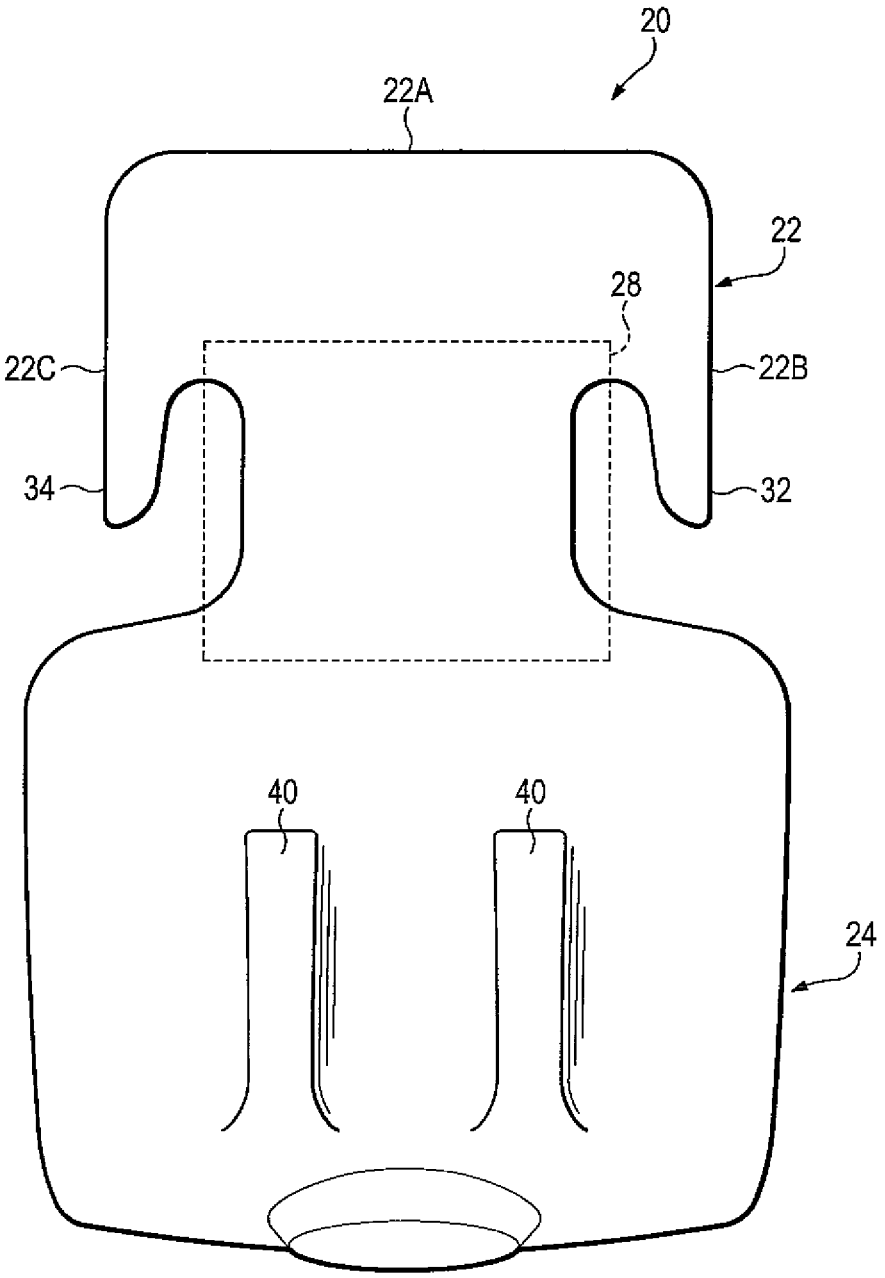
FIG. 9 is a top view of the base with another alternative configuration.

In another alternative configuration, the edges of the side channels may include portions that are at 45 degrees inclination to the longitudinal axis as shown in FIG. 8. In another alternative configuration, upper throat 29 is narrower than weld flange 22 and seat 24, and weld flange 22 is narrower than seat 24. The shape of feature outlines of base 20 may vary within a broad range of configurations and, when intended for a similar function, still fall within the scope of the invention.

Referring again to FIG. 2, base 20 further includes retention member 40 forward of upper throat 29 on seat 24. In this embodiment, retention member 40 includes a rearward facing bearing surface 41 that generally aligns with opening 12A when wear member 12 is assembled to base 20. A lock 42 is assembled in opening 12A and is received by retention member 40 to secure wear member 12 on lip 14. Retention member 40 and opening 12A may be located elsewhere on base 20 and have different constructions than what is shown in FIG. 2.

Base 20 may be cast as a single piece with minimal machining required. Due to the size of base 20, the particular metals used in excavating equipment, and certain efficiencies in mold assembly, the resulting cast piece is subject to dimensional variations. Base 20 may therefore further include one or more fit pads 44 that may be machined to optimize fit of mating components. Fit pads may be formed on inward surfaces that contact the lip and on outward surfaces of the seat that receive the cavity of wear member 12.

In another embodiment, base 20 may include only one welding flange. For example, instead of a lower welding flange, the base 20 may include a lower leg that attaches to the lower surface 18 of lip 14 in a different manner than welding, such as a bolt or boss, or is attached in a more conventional welding arrangement (e.g., without a strain relief area). In yet another embodiment, outer leg 12C of wear member 12 includes a second retention feature that engages a corresponding retention feature on and outer portion of base 20 or outer lip surface 18 to further anchor wear member 12 to lip 14. This example construction may be used to support a wing as a wear member. The various embodiments are usable on many kinds of digging edges including, e.g., plate and cast lips, and the forward edges of bucket sidewalls.

Upper and lower in this application are used to describe the primary embodiment, which is the attachment of a wear component to a lip. The invention, however, is not so limited. For example, in the example of a wing, the legs would be inside and outside but may not be upper and lower.

Figure 10:
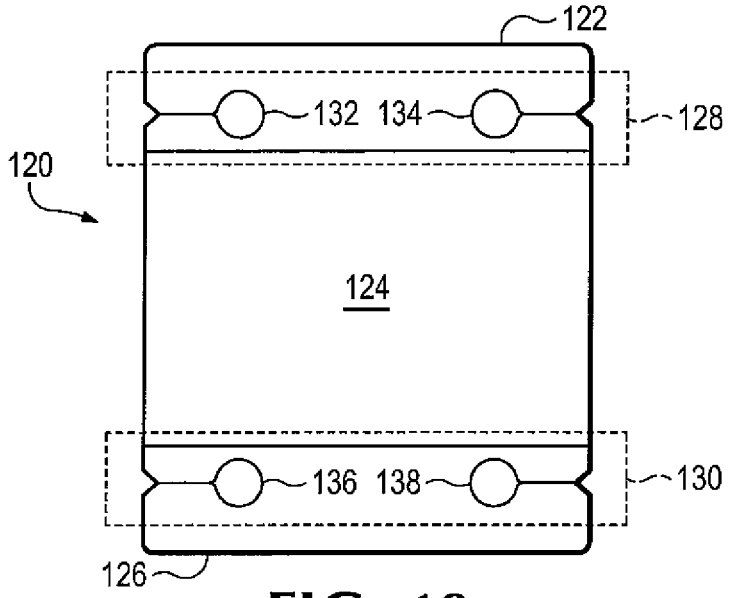
FIG. 10 is a top view of a runner with strain relief areas.

The concepts of the invention are applicable to other applications. FIG. 10 shows a runner or other wear member 120 such as might be attached to a face of earthmoving equipment to prevent wear of such equipment like a bucket, a chute, a truck body, etc. The middle portion of the runner is a working portion 124 defined as a wearable surface, and weld flanges 122 and 126 are at each end of runner 120. This construction could also, alternatively, but used in a base for a runner, in which case the working portion is a seat. In a base, the seat would have a structure to support the runner and preferably a retention element to secure the runner in place such as in U.S. Pat. Nos. 5,063,695 and 5,241,765, which are incorporated herein by reference. In runner 120, strain relief areas 128 and 130 separating the seat and weld flanges include slots 132, 134, 136, 138 cut transversely into each side at opposite ends of the runner. Holes are cut or drilled at the terminal end of each slot. Weld flanges 122 and 126 at opposing ends of runner 120 are welded to the support structure such as a bucket surface, while the seat 124 and strain relief areas 128 are separate (i.e., not welded) from the structure. Loads applied at the seat (i.e., by the runner) are regulated by the strain relief so that the stress is distributed more evenly across the welds at the outside edge of the weld flange.

Figure 11:
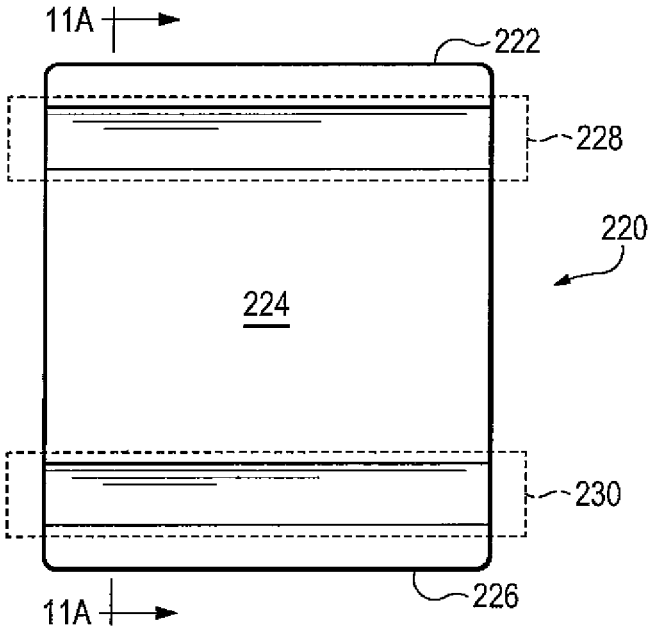
FIG. 11 is a top view of an alternative configuration of a runner with strain relief areas.
Figure 11A:
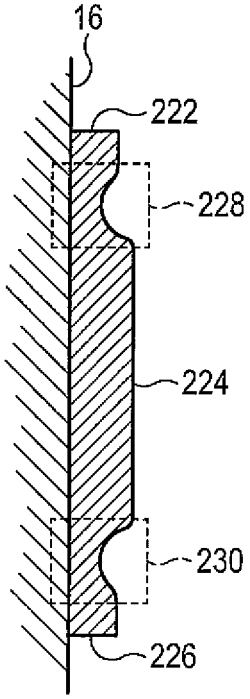
FIG. 11A is a side cross section view of the runner of FIG. 11 with strain relief areas.

FIG. 11 shows a runner 220 similar to the runner of FIG. 10. Base 220 includes a seat 224, strain relief areas 228 and 230, and weld flanges 222 and 226 welded to the structure. Here the strain relief is a thinned portion that modifies the stiffness and increases the flexure in the area in comparison to the balance of the runner. FIG. 11A is a side cross section view of FIG. 11 showing the thinning of the runner in the strain relief area 226.

Stiffness of a component is the inverse of the flexibility of the component and both indicate the tendency of the component to deflect under an applied force. Stiffness is an extrinsic property because it is dependent on the shape of the component. A thinner, longer component will be less stiff and more flexible along its axis than a shorter wider configuration of the same material. A stiffer component will deflect less than a more flexible component of the same material under the same applied force.

The modulus of elasticity is an intrinsic property. It's not dependent on the shape of the component, but on the property of the material. Steel has a higher modulus of elasticity than rubber or most plastics. The modulus again is related to how much a component will bend or deflect under an applied force. A strain relief may incorporate modified material composition and/or configuration of the component to provide increased deflection under load compared to other parts of the component.

Rather than a thinning of the runner, the modulus of elasticity in the strain relief area may be modified by a change of material properties in the area. The strain relief area could be heat treated so that the crystal structure is different in this area.

Alternatively, the strain relief can be effected by a different material in this area that modifies the elasticity. The strain relief area could have a more ductile material secured between the seat and the weld flanges. Alternatively, the more ductile material could be welded on opposite ends of the seat to form both the strain relief area and the weld flange. The welding flange and the strain relief area may be a more ductile material than the seat, but the welding flange will have a high stiffness due primarily to being fixed and anchored to the underlayment or base.

Figure 12:
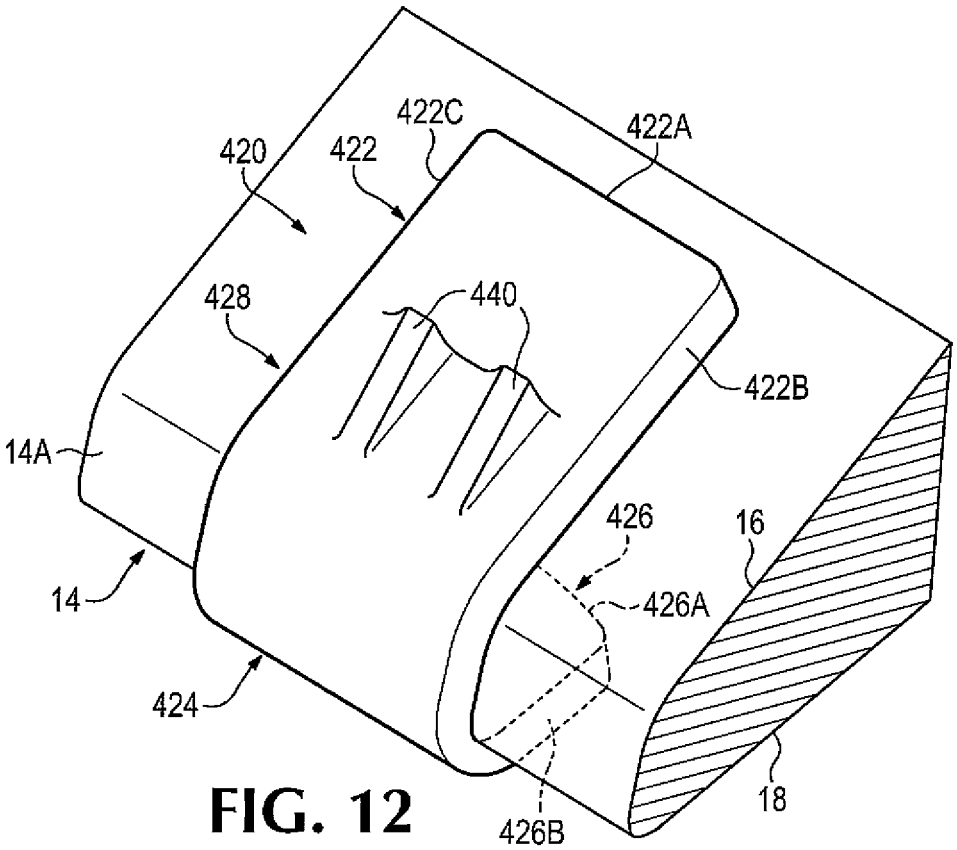
FIG. 12 is a perspective view of alternative configuration of a base welded to a lip of excavating equipment.

Alternatively, the entire unwelded portion of the component may comprise the strain relief area. FIG. 12 shows a base 420 with a seat 424 and weld flanges 422 and 426 welded to upper and lower surface 16 and 18 of lip 14. Here seat 424 of base 420 is separate and uncoupled from lip 14 and is free to flex and deflect within the limits of the welded flanges. Seat 424 forward of the welded edges 422A, 422B, 422C flexes to function as a strain relief area 428. The seat and strain relief in this example overlap.

The method of attachment has been described as welding of the flanges to a surface, but other methods can be used. The base can be bolted to the surface. A working portion and a strain relief portion flex and deflect under loads that are transferred through the base to the bolts anchoring the flanges to the surface.

Alternatively, portions of the base, or the entire base, can be cast with the underlying surface. The flanges can be cast as part of the underlying surface and the strain relief and working portion welded to the cast flanges. Alternatively, the entire base can be cast as part of the underlying support surface with the strain relief and the working portion spaced from the underlying surface. This again allows the strain relief and working portion to flex and deflect under loads applied to the working portion without concentrating stresses that have in the past caused cracking in the components.

While the application has described the invention primarily in terms of bases for supporting wear members, the invention could also be employed in wear components that are defined as a wear member. In these embodiments, the working portion would define a wearable portion in direct contact with the ground (such as the forward wearable portion of a shroud) rather than a seat for receiving a wear member. Although, shroud is mentioned as an example, the invention could be used in other welded wear members for other edges or broad surfaces on earthmoving equipment.

It is believed that the disclosure set forth herein encompasses multiple distinct inventions with independent utility. While a base for a wear member has been disclosed in its preferred form, the specific embodiments thereof as disclosed and illustrated herein are not to be considered in a limiting sense as numerous variations are possible. While different configurations have been described to achieve a specific functionality combinations of these configurations may be used and still fall within the scope of this disclosure. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A wear assembly comprising:

a base adapted to be welded to a digging edge of an excavating bucket, wherein the bucket has an inner face, an outer face and a front edge face, the base including:

a seat bearing on the front edge face and extending from the front edge face along the inner and outer faces of the digging edge and separate from the digging edge;

a weld flange rearward of the seat secured to the inner face of the digging edge; and a retention feature;

where the seat is coupled to the weld flange by a strain relief where the strain relief is more flexible than the seat and weld flange;

a wear member received over the base and including an aperture generally aligned with the retention feature; and a lock received in the aperture to bear against the retention feature of the base and hold the wear member to the base.

2. A wear assembly in accordance with claim 1 in which the wear member includes spaced apart legs wherein a first leg includes the aperture and a second leg is shorter than the first leg.

3. A wear assembly in accordance with claim 1 in which the base defines a longitudinal axis and the wear member is received over the base along the longitudinal axis.

4. A wear assembly in accordance with claim 1 in which the retention feature of the base includes a bearing surface that is rearward facing to contact the lock.

5. A wear assembly in accordance with claim 1 where the strain relief is a throat portion narrower than the seat.

6. A wear assembly in accordance with claim 1 where the base includes a second weld flange rearward of the seat welded to an outer face of the digging edge.

* * * * *